United States Patent [19]

Arya

[11] Patent Number: 4,530,409

[45] **Date of Patent: * Jul. 23, 1985**

[54] OFFSET DRIVER ACCESSORY

[75] Inventor: Satya P. Arya, San Jose, Calif.

[73] Assignee: Ingersoll-Rand Company, Woodcliff Lake, N.J.

[ * ] Notice: The portion of the term of this patent subsequent to May 4, 1999 has been disclaimed.

[21] Appl. No.: 358,864

[22] Filed: Mar. 17, 1982

Related U.S. Application Data

[63] Continuation-in-part of Ser. No. 084,668, Oct. 15, 1979, Pat. No. 4,327,806.

[51] Int. Cl.[3] ..... B25D 17/00; E21D 20/00

[52] U.S. Cl. ..... 173/131; 173/132; 405/259

[58] Field of Search ..... 173/128, 129, 131, 132; 405/259, 260, 303

[56] References Cited

U.S. PATENT DOCUMENTS

| | | | |
|---|---|---|---|
| 1,042,873 | 10/1912 | Betts | 173/131 X |
| 2,605,808 | 8/1952 | Current | 173/131 X |
| 3,600,928 | 8/1971 | Retherford | 173/131 X |
| 3,699,799 | 10/1972 | Paine et al. | 173/131 X |
| 3,922,867 | 12/1975 | Scott | 405/259 |
| 4,051,906 | 10/1977 | Donegan | 173/131 X |
| 4,327,806 | 5/1982 | Arya | 173/131 X |

*Primary Examiner*—E. R. Kazenske
*Assistant Examiner*—Willmon Fridie, Jr.
*Attorney, Agent, or Firm*—B. J. Murphy

[57] ABSTRACT

The invention comprises an Accessory for use with a driver for forceably inserting friction rock stabilizers into bores formed in earth structures (such as mine roofs). In the depicted embodiments, the Accessory comprises an elongate body having a driver element with a pin or boss at one, lower, "driven" end of the body for engaging and supporting an end of a stabilizer, and a second driver element with a socket, at the opposite, upper, "driving" end of the body for receiving an insertion tool. The latter driver element can be pivotably offset, to accommodate an angled, unobstructed address of the insertion tool to the *upper* end of the body, and to enable a linear insertion of a stabilizer, supported on the *lower* end of the body, into a bore. In accommodating a driver at the *upper* end of the body, to forceably insert a stabilizer which has its termination supported on the *lower* end of the body (the insertion force, therefore, being applied through the body), the Accessory facilitates bore insertion of lengthy stabilizers, by means of conventional tools, in low headroom, subterranean openings.

8 Claims, 9 Drawing Figures

FIG. 6
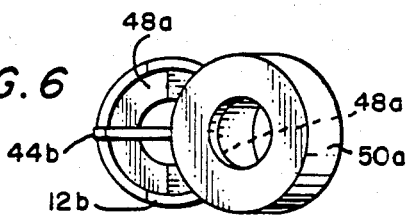
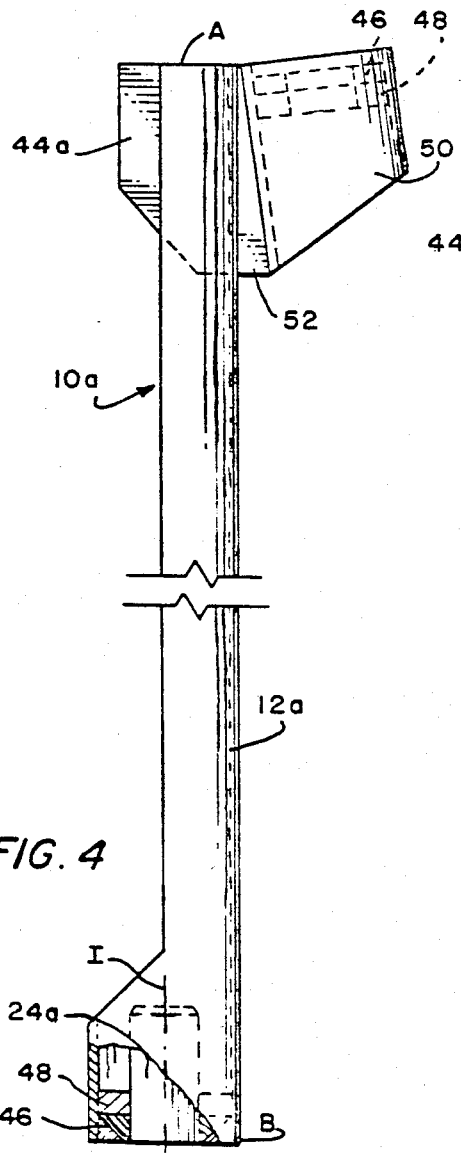
FIG. 4
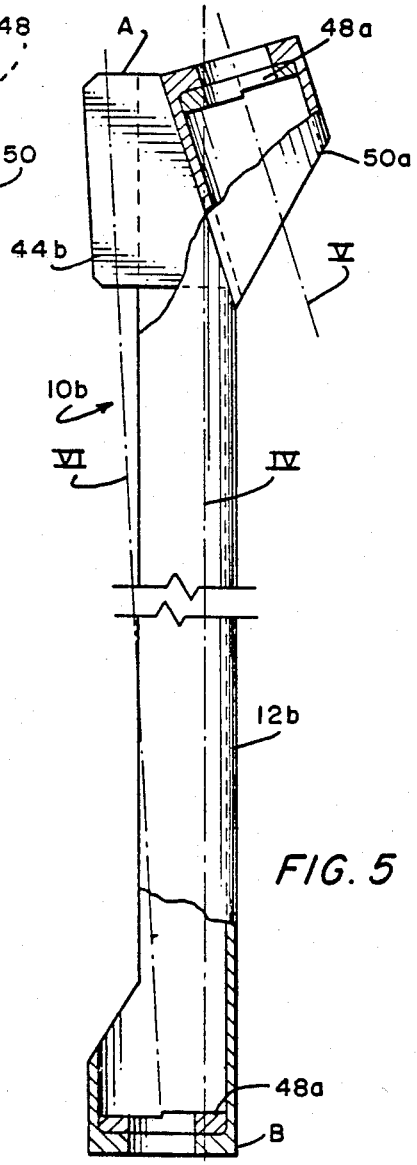
FIG. 5

OFFSET DRIVER ACCESSORY

This is a continuation-in-part of my co-pending patent application Ser. No. 084,668 filed on Oct. 15, 1979, for an Offset Driver Accessory now U.S. Pat. No. 4,327,806.

In recent years, friction rock stabilizers, particularly those sold under the trademark "Split Set", by Ingersoll-Rand Equipment Corporation, have become quite popular for stabilizing or anchoring metal mine roofs. These stabilizers are manufactured in the form of split tubes, varying in length from three feet to eight feet, and are exemplified by the U.S. Pat. No. 3,922,867, issued Dec. 2, 1975, to James J. Scott, for "Friction Rock Stabilizer". Pneumatic insertion tools like jackdrills and stopers are frequently used for installation of these stabilizers.

Jackdrills and stopers have a minimum working height of about five feet. Accordingly, in low headroom mines (as low as 5'-0"), friction rock stabilizers cannot be installed, directly, with standard jackdrills or stopers. A special tool or accessory is required which, when used with conventional drivers (such as jackdrills or stopers), will enable the insertion of the stabilizers into low headroom mine roofs or the like.

It is an object of this invention to provide the required tool or accessory. Particularly it is an object of this invention to set forth an offset, driver accessory, for inserting friction rock stabilizers in earth bores, comprising an elongate body; means at one end of said body for engaging an end of a friction rock stabilizer; and means at the opposite end of said body for receiving a driver tool; wherein said body and said receiving means have centerline axes which define an acute angle therebetween. It is also an object of this invention to provide an offset, driver accessory, for inserting longitudinally slit rock stabilizers in earth bores, comprising an elongate body; means at one end of said body for engaging an end of a friction rock stabilizer; and means at the opposite end of said body for receiving a driver tool; wherein said body and said receiving means have centerline axes which define an acute angle therebetween; said body comprises means for providing lateral, contacting support to a friction rock stabilizer upon such being engaged with said engaging means thereof; and said support-providing means comprises key means (1) for laterally engaging the longitudinal slit of a friction rock stabilizer and (2) for slidably guiding the latter during earth bore insertion thereof.

Further objects of this invention, as well as the novel features thereof, will become more apparent by reference to the following description taken in conjunction with the accompanying figures, in which:

FIG. 4 is a discontinuous, partly cross-sectioned, side elevational view of an alternative embodiment of the invention;

FIG. 5 is a discontinuous, partly cross-sectioned, side elevational view of yet a further alternative embodiment of the invention;

FIG. 6 is a top or plan view of the embodiment of FIG. 5;

Figure 1:
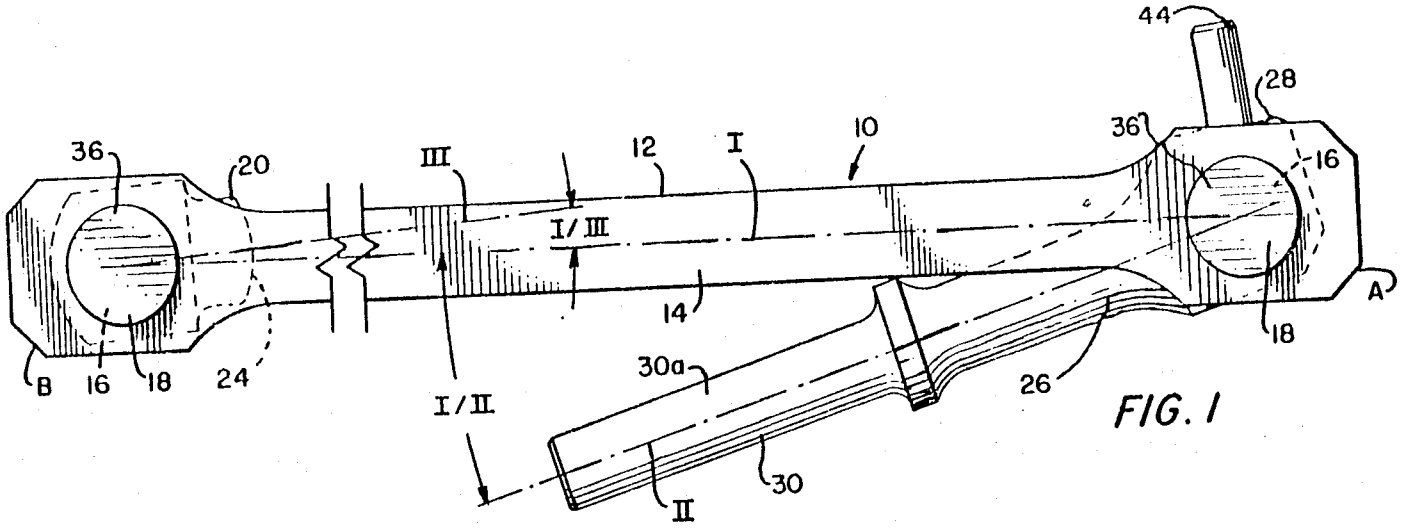
FIG. 1 is a discontinuous, side elevational view of an embodiment of the invention.
Figure 2:
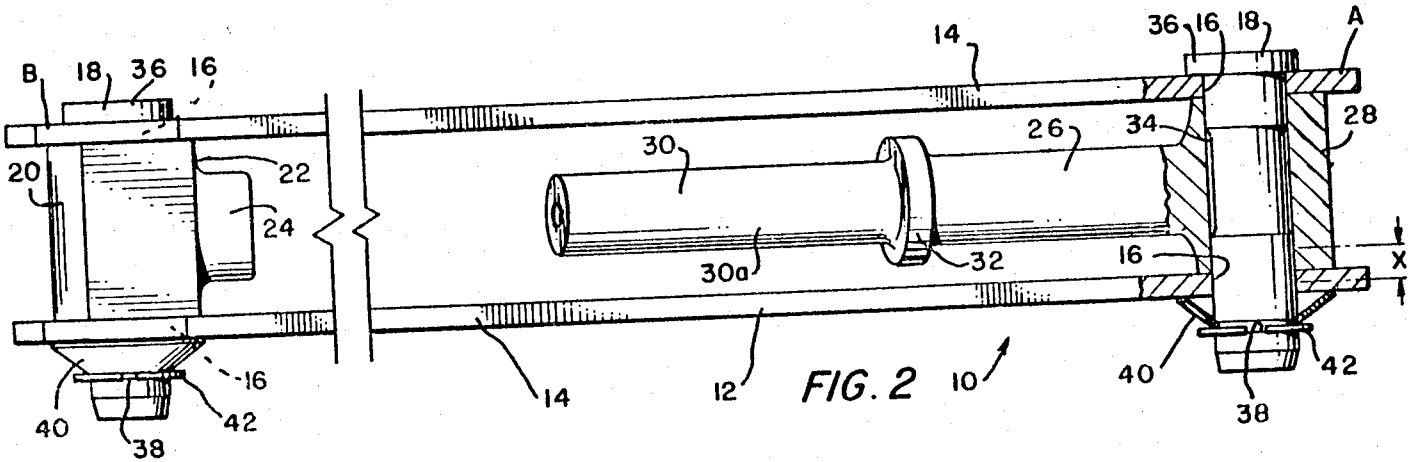
FIG. 2 is a discontinuous, front elevational view, partly cross-sectioned, of the FIG. 1 embodiment.
Figure 3:
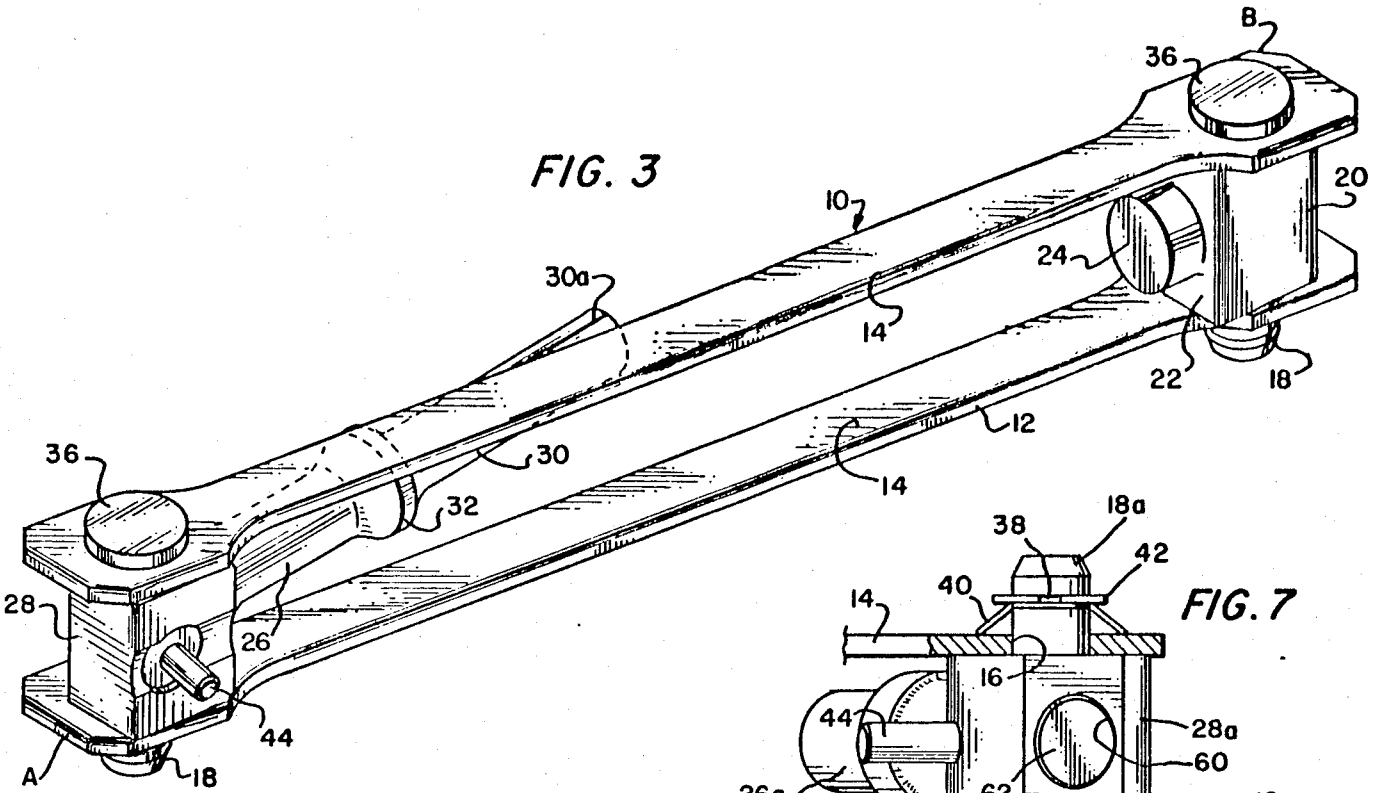
FIG. 3 is an isometric projection of the FIG. 1 embodiment.

As shown in FIGS. 1 through 3, an offset, driver accessory 10, according to a first embodiment thereof, comprises a rigid body 12 formed of a pair of parallel, matching bars 14 of a given length. As shown in FIG. 2, bars 14 are straight from end to end thereof. Due to the directly-engaged mechanical connection of drivers 20 and 26 with bars 14, through the studs 18, insertion forces addressed to the tool-receiving, pivot driver 26 are directly communicated to the bars 14 and, therethrough, directly to the stabilizer-engaging driver 20. Opposite ends of the bars 14 have bolt apertures 16 formed therein to receive studs 18 therethrough.

The body 12 has a "drive" end A and a "driven" end B, the two being so identified in that end A in configured to receive an insertion tool—such as one of the aforesaid jackdrills or stopers, or the like—to impart friction rock stabilizer insertion or "drive" forces thereto; end B, however, is configured to engage an end of a friction rock stabilizer for communicating thereto the aforesaid forces (to cause the stabilizer to be "driven" into an earth bore).

The stud 18, which bridges between bars 14 at end B mounts a stabilizer driver 20 thereat. The driver 20, of a length less than that of bars 14, has a flat, generally-rectangular land 22 and, from centrally of the latter, there projects a prominent, short stub 24. Stub 24 engages the inside diameter of a friction rock stabilizer, the end of the latter being received on the land 22.

The other stud 18, at end A, mounts a tool driver 26. Driver 26, also of a length less than that of bars 14, comprises a centrally bored head 28 from which there extends an elongate rod 30. Intermediate the ends of rod 30 there is formed an enlarged annulus 32. The pendant end 30*a* of rod 30 defines a receiver for a stabilizer insertion tool, and the annulus 32 comprises a limit stop for the tool.

Drivers 20 and 26 can be pivoted, to desired angulations relative to bars 14, by means of strong manual force applied thereto, or by tapping the stub 24 or rod 30, lightly, with a hammer or mallet.

The cut-away or partially cross-sectional view at end A shown in FIG. 2 is common to end B as well, as concerns the mating relationship between the stud 18 and its related driver 26 (and the other stud 18 and its related driver 20). That is, each stud 18 has a relief 34 formed therein, intermediate the ends thereof, to cause "drive" and "driven" forces to be impressed only on the ends thereof—in proximate adjacency to the bars 14. This expedient restricts the bending moment to very short spans (of which dimension "X" is representative) between the bearing surfaces of the studs 18 and the bars 14.

Each stud 18 has a head 36 at one end and a snap ring groove 38 adjacent the end opposite. A belleville-type washer 40 is fitted about the opposite end of each stud 18, the washer 40 being secured in place by a snap ring 42 which nests in the groove 38. Accordingly, replacement of driver 20 or 26 (or bars 14) is facilely accommodated.

Body 12 has a centerline axis "I" and, in operating disposition (as shown) the tool pivot driver 26 has a centerline axis "II" which is acutely, angularly offset from axis "I". The offset angle "I/II" is approximately fifteen degrees of arc, and allows for a close-in engagement of an insertion tool with the driver 26.

Driver 20 also has a centerline axis "III" offset at an acute angle "I/III" and this allows the stabilizer to lie alongside the drive end A for, and during, borehole insertion; it also accommodates for side-loading of stabilizers onto the accessory 10.

The more common form of friction rock stabilizer has an axially-extending slit formed in the wall thereof. To accommodate such slit, and more surely to guide the stabilizer during its driven insertion, the novel accessory 10 carries a stabilizer-slit key 44. Key 44 extends outwardly, from the head 28 of driver 26, normal to the axis of stud 18 thereat and substantially normal to the centerline axis "III" of driver 20. Key 44 engages the slit in the stabilizer, to guide the latter, as aforesaid; the head 28 defines a bearing surface for receiving thereon one side of the stabilizer, and providing lateral support thereto.

The accessory 10 is convenient to use and installs stabilizers satisfactorily when used with jackdrills, stoppers or similar equipment. It transmits impact energy efficiently to the stabilizer because of its low weight and, as is explained in the ensuing test, special positioning of load transfer points. The low weight of the accessory was achieved by reducing the bending moments to one tenth, compared to prior, known designs. As noted, studs 18 are both undercut to position the loading close to the parallel bars 14. The stabilizer can be emplaced from the side of the accessory 10, resulting in quick engagement and reduced installation time. The accessory 10 is of weldfree construction; all parts can be assembled or disassembled readily, and worn out components can be replaced readily. It is much lighter in weight as compared to other units; it weights about 12 lbs. It is made out of commercially available, heat treatable, alloy steels. The accessory 10 is of simple and economical design and can be produced by ordinary machine shops. Expected life of the unit is appreciable.

This embodiment has been favorably tested to an equivalent of one thousand stabilizer insertions, and is now being tested in the field. Accessory 10 can transmit up to about one hundred ft-lb of impact energy per blow, satisfactorily, and can be built to larger dimensions, with same configurations, to work with large machines like Jumbos.

An alternative accessory embodiment 10*a*, according to the invention, is shown in FIG. 4. Basically, this embodiment is formed from stock tubing and, notwithstanding the differences in design between embodiments 10 and 10*a*, same or similar index numbers denote same or similar structures. Also, the Roman numeral "I", again, denotes the centerline axis of the body 12*a*. The body 12*a* of accessory 10*a* is formed of tubing, as noted, in which a substantial portion thereof—on the left (as viewed in FIG. 4), stabilizer entry side—is cut away. Accordingly, that portion of the body defines a sort of cove in which to nest the stabilizer. The driven end B retains the full wall of the tubing and mounts centrally therein a stub or dowel 24*a*. As can be seen, this stabilizer-engaging stub or dowel 24*a* has a centerline axis in common with the centerline axis "I" of the body 12*a*. Dowel 24*a* is secured by a ring 46, by welds, and is further rigidized by a ring-surmounting, annular insert 48. Insert 48 and end B of the tubing define a cup-shaped receiver for the end of the stabilizer; as with stub 24 of embodiment 10 (FIGS. 1–3), dowel 24*a* engages the i.d. of the stabilizer.

Another cup-shaped receiver 50, also having a welded in place ring 46 and surmounting insert 48, is welded to end A of body 12*a*, at an offset angle, by means of an interpositioned wedge 52. Receiver 50, of course, accommodates therein the working end of an insertion tool. A thin, flat key 44*a* projects from the "cove" of end A to guidably engage the slit of a friction rock stabilizer.

Yet a further accessory embodiment 10*b* is shown in FIGS. 5 and 6. In this embodiment means are provided to transfer to or impose loading on the neutral axis thereof. Otherwise, it is quite similar to embodiment 10*a*, having a body 12*b* formed substantially of half tubing. The neutral axis "IV" bisects the centerline axis "V" of the installation tool (not shown), which is received in the cup-shaped receiver 50*a*, beyond the image area of FIG. 5. More, however, receiver 50*a* has a one-piece, stepped insert 48*a* which causes the tool forces to be addressed along the neutral axis IV; the innermost, thicker-step portion of the insert 48*a*, which "bottoms" the tool, is traversed by the neutral axis "IV".

Similarly, end B of body 10*b* has another one-piece, stepped insert 48*a*, the thicker, stabilizer-end engaging portion of which is traversed by the neutral axis "IV".

By these means, bending moments are substantially eliminated.

Axis "VI" defines the centerline of the stabilizer and, as can be seen, is parallel with the outermost edge of the key 44*b*.

Figure 7:
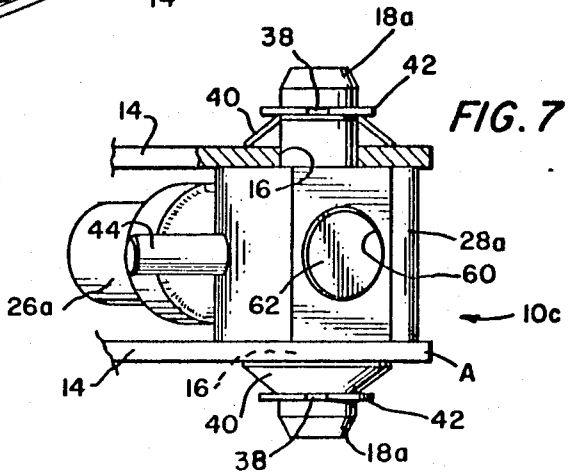
FIG. 7 is a fragmentary view, partially cross-sectioned, of the drive end of a further alternative embodiment of the invention illustrative of the slidably replaceable driver.

The further, alternative embodiment 10*c*, in FIG. 7, is similar to embodiment 10, having bars 14 and a driven end like that of end B of embodiment 10. The drive end A, however, is differently constructed to accommodate replaceable drivers—such as driver 26*a*. In this embodiment a header 28*a*, which has oppositely-extending pivot limbs 18*a* integral therewith, is pivotably received in apertures 16 formed in bars 14. The limbs 18*a* have grooves 38 formed therein to receive snap rings 42 therein to constrain bellevill-type washers 40 against the bars 14—the washers 40, of course, securing the header 28*a* in place. Header 28*a* has a radial borehole 60 formed therein for replaceably received therein a mating shank end 62 of a driver 26*a*.

Figure 9:
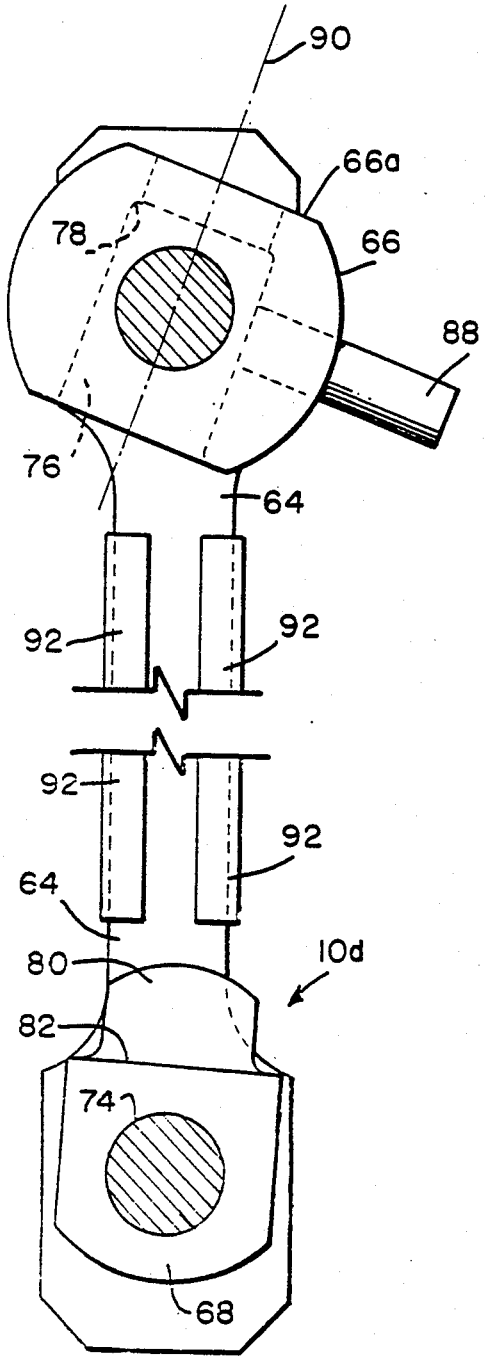
FIG. 9 is a discontinuous, cross-sectional view of the embodiment of FIG. 8, taken along section 9—9 of FIG. 8, except that the driver elements are shown in offset angulations.
Figure 8:
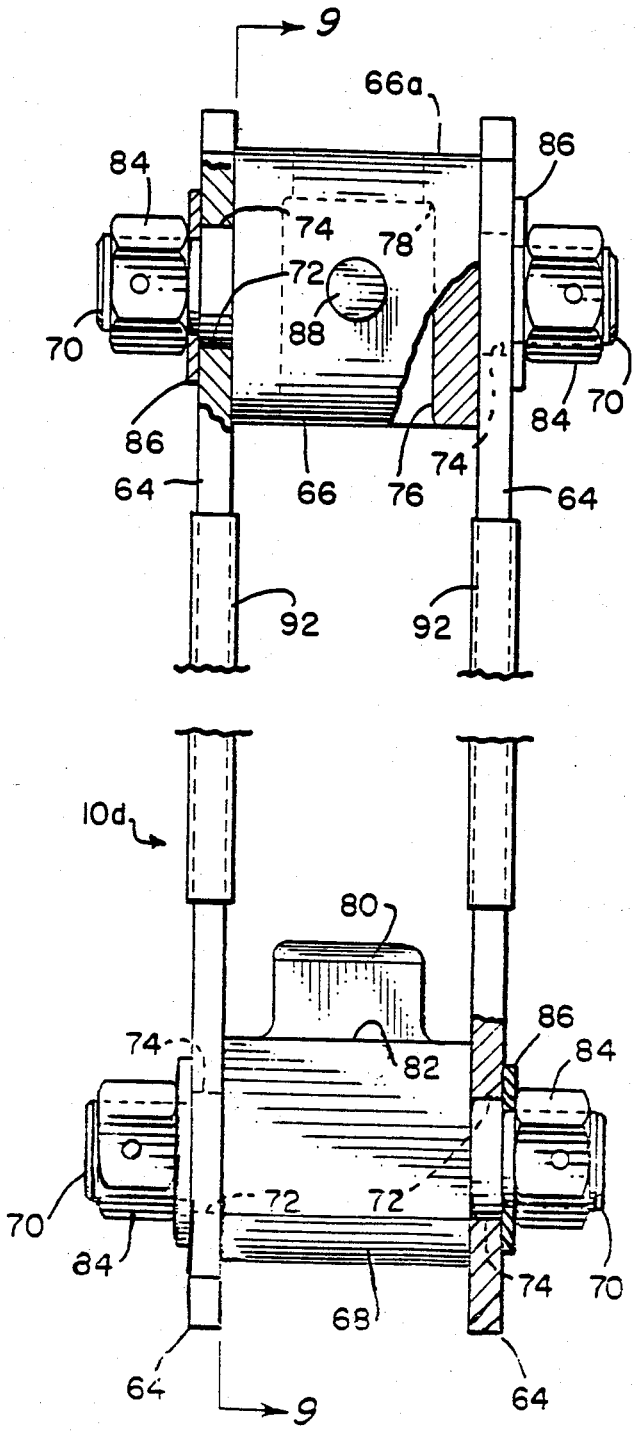
FIG. 8 is a discontinuous, front elevational view, partly cross-sectioned, of another alternative embodiment of the invention with the driver elements thereof in straight alignment.

Shown in FIGS. 8 and 9, is still another, alternative embodiment 10*d* of the novel offset driver accessory. It is somewhat similar to the embodiment comprised by FIG. 1. In this embodiment 10*d* there are a pair of parallel bars 64 of common length and configuration, each thereof being rigid and, as shown in FIG. 8, straight from end to end. The bars 64 are bridged across, at opposite ends thereof, by an insertion tool-engaging driver 66 and a stabilizer-engaging driver 68. Each driver has, on opposite ends thereof, threaded stub shafts 70 which pass through apertures 72 formed in, and adjacent to the ends of, the bars 64. Intermediate the threaded stub shafts of the drivers, and the substantial body portions 66*a* and 68*a* thereof, which abut and bridge between the bars 64, are shoulders 74 which intimately engage the apertures 72 formed in the bars 64. The insertion tool-engaging driver 66 has an aperture 76 formed therethrough, having first and second diameters defining therebetween a shoulder 78, comprising a socket in which to receive and nest an insertion tool. The stabilizer-engaging driver 68 has prominent pin or boss 80 about which is defined a land 82 for receiving one end of a friction rock stabilizer.

The drivers 66 and 68 are pivotably mounted or journalled on the shoulders 74 in the apertures 72. Hence, they can be set at convenient, operative angles, as shown in FIG. 9, by untorquing, or unthreading lock nuts 84, threaded on the stub shafts 70, by means by which each is fastened, with lock washers 86, to the bars 64. After adjusting the driver angles, it is only necessary to retorque the lock nuts 84.

The insertion tool-engaging driver 66 has a guide pin 88 projecting therefrom normal the axial centerline 90 of the tool socket aperture 72. The guide pin 88, like key 44 (FIG. 1) is received in the slit of the friction rock stabilizer and serves to guide the stabilizer in a linear travel during insertion thereof into an earth bore. Each of the bars 64 has clasped thereto plastic wear strips 92 to prevent undue scoring, abrasion or other wear of the bars during use with an insertion tool.

While I have described by invention in connection with specific embodiments thereof, it is to be clearly understood that this is done only by way of example, and not as a limitation to the scope of the invention as set forth in the objects thereof and in the appended claims.

I claim:

1. An offset driver accessory, for inserting friction rock stabilizers in earth bores, comprising:

rigid, elongate bars of a given length, and of substantially straight configurations from end to end thereof;

first means, having a directly-engaged mechanical connection with said bars, adjacent to one end of each, for engaging an end of a friction rock stabilizer; and second means, also having a directly-engaged mechanical connection with said bars, adjacent to the opposite ends thereof, for receiving a friction rock stabilizer insertion tool whereby, upon any insertion forces being addressed to said second means, such forces are directly communicated to said bars and, therethrough, directly to said first means; and wherein said first means comprises means which defines a land for engaging an end of a friction rock stabilizer; and at least one of said first and second means is pivotably coupled to said bars.

2. An offset driver accessory, according to claim 1, wherein:

said first and second means are both pivotably coupled to said bars.

3. An offset driver accessory, according to claim 1, wherein:

said bars comprise a pair of parallel bars of matching configuration, having apertures formed therein adjacent the opposite ends thereof;

said first and second means comprise a stabilizer-engaging driver, and an insertion tool-engaging driver, respectively; and said drivers have threaded stub shafts which are pivotably mounted in said apertures.

4. An offset driver accessory, according to claim 3, wherein:

said insertion tool-engaging driver has a tool-receiving socket formed therein.

5. An offset driver accessory, according to claim 4, wherein:

said tool-receiving socket comprises an aperture formed in said tool-engaging driver.

6. An offset driver accessory, according to claim 5, wherein:

said tool-engaging driver has a guide pin coupled thereto and extending therefrom.

7. An offset driver accessory, according to claim 6, wherein:

said aperture in said tool-engaging driver has an axial centerline; and said guide pin extends perpendicular to said centerline.

8. An offset driver accessory, according to claim 3, further including:

lock nuts threadedly engaged with said stub shafts for fastening said drivers to said bars at selected, pivoted angulations relative to said bars.

* * * * *